US006168013B1

(12) United States Patent
Gomes

(10) Patent No.: US 6,168,013 B1
(45) Date of Patent: Jan. 2, 2001

(54) COMPACT BASKET-STYLE CARRIER BLANK

(75) Inventor: Jean-Manuel Gomes, Marietta, GA (US)

(73) Assignee: Riverwood International Corporation, Atlanta, GA (US)

( * ) Notice: Under 35 U.S.C. 154(b), the term of this patent shall be extended for 0 days.

(21) Appl. No.: 09/267,152

(22) Filed: Mar. 11, 1999

(51) Int. Cl.[7] ..... B65D 5/462
(52) U.S. Cl. ..... 206/162; 206/180; 206/193
(58) Field of Search ..... 206/141, 162, 206/167, 193, 198, 174, 175, 170, 180, 191, 427; 294/87.2

(56) References Cited

U.S. PATENT DOCUMENTS 2,772,020 * 11/1956 Kramer ..... 206/180
3,011,677 * 12/1961 Struble ..... 206/180
3,721,368 * 3/1973 Arneson ..... 206/180
3,850,292 * 11/1974 Manizza et al. ..... 206/180
4,782,944 * 11/1988 Engdahl, Jr. ..... 206/170
5,531,319 * 7/1996 Harrelson ..... 206/170

FOREIGN PATENT DOCUMENTS

98/28200 * 7/1998 (WO) .

* cited by examiner

*Primary Examiner*—Paul T. Sewell
*Assistant Examiner*—Luan K. Bui

(57) ABSTRACT

A carrier blank (40) for making a basket-style carrier (10) for containing and carrying a plurality of articles, with the carrier blank (40) including an elongate central section (41) and first and second exterior sections (42, 43) formed alongside the elongate central section. The elongate central section has formed therein side panels (21, 22) and end panels (18, 19). The first exterior section has formed therein a plurality of handle panels (26) and partitions (38, 39). The second exterior section has formed therein first and second bottom panels (31, 32). The bottom panels (31, 32) are sized, shaped, and spaced to be nestably received in spaces adjacent bottom panels of an adjacent carrier blank. With the exception of the bottom panels (which can be nestably received with adjacent bottom panels of an adjacent carrier blank), the remainder of the carrier blank comprises a substantially rectangular shape to minimize waste.

7 Claims, 7 Drawing Sheets

COMPACT BASKET-STYLE CARRIER BLANK

TECHNICAL FIELD

The present invention relates generally to a basket-style carrier for carrying articles, such as beverage bottles. In particular, the invention relates to a compact carrier blank for making such a carrier.

BACKGROUND OF THE INVENTION

One of the types of carriers commonly employed to package beverage bottles is the so called "basket-style" carrier. These carriers typically include a number of partitions for defining separate cells for the bottles and a handle for carrying. They are easily lifted and carried, most have good strength, and the cell partitions tend to protect the bottles against contact with one another. If the bottles are not of the disposable type, they can be returned in the original carrier for recycling since the carrier is not destroyed by removal of the bottles therefrom.

In order to strengthen the handle of the basket-style carrier, it is common in the industry to make the handle of multiple plies or panels. This is the preferred way of strengthening a handle. It is known in the art that one can strengthen a carrier handle by increasing the paperboard thickness (caliber). However, this has the disadvantage of driving up the cost of the carrier, inasmuch as one of the predominate costs in malking a carrier is the cost of the paperboard itself.

In the making of basket-style carriers, it is common that the blank used to assemble the carrier has an irregular shape, such as having a large protuberance extending off to one side. Indeed, some carrier blanks for making basket-style carriers are generally L-shaped. Furthermore, some carrier blanks include large open spaces. An example of such is shown in international published patent application WO 98/28200 for an ARTICLE CARRIER AND BLANK THEREFOR, published Jul. 2, 1998. As can be seen in FIG. 1 of WO 98/28200, a large unused region is present in one corner of the blank. This leads to substantial inefficiency and unnecessarily high costs in the manufacture of such a blank and a basket-style carrier assembled therefrom.

Accordingly, it can be seen that a need yet remains for a carrier blank for a basket-style carrier which minimizes the amount of paperboard necessary to make such a blank, and therefore keeps manufacturing costs thereof to a minimum. It is to the provision of such a carrier blank that the present invention is primarily directed.

SUMMARY OF THE INVENTION

Briefly described, in a first preferred form the present invention comprises a compact carrier blank for forming a basket-style carrier for containing and carrying a plurality of articles. The carrier blank includes an elongate central section having an axis of elongation and having formed therein side panels and end panels. The carrier blank also includes a first exterior section formed alongside the elongate central section and having formed therein a plurality of handle panels. The carrier blank also includes a second exterior section formed alongside the elongate central section opposite the first exterior section. The first and second exterior sections flank the elongate central section, with the second exterior section having first and second bottom panels formed therein.

Preferably, the first and second bottom panels are sized, shaped, and spaced from one another to create open spaces adjacent the first and second bottom panels to allow bottom panels of an adjacent carrier blank to be nestably received therein. Preferably, the bottom panels are tapered to facilitate the nesting.

Also preferably, the plurality of handle panels are hingedly attached to one another about an axis which is transverse to the axis of elongation. In other words, the handle panels fold one against another lengthwise in the direction of the elongation of the carrier blank.

Preferably, the first exterior section also includes a divider flap formed therein for dividing an interior of the basket-style carrier when assembled from the carrier blank. Also preferably, one of the handle panels is formed in a full-height divider panel which spans the elongate central section and the first exterior section. Preferably, the full-height divider panel includes a partition for, when the carrier blank is assembled into a finished carrier, extending from the full-height divider panel to one of the side panels.

Preferably, the carrier blank has a peripheral edge along the first exterior section which is substantially straight and has a peripheral edge along the second exterior section which is substantially shaped like a series of teeth. Preferably, the carrier blank, with the exception of the bottom panels, has a substantially rectangular overall shape, thereby maximizing the utilization of the paperboard and minimizing waste.

Carrier blanks according to the present invention are very advantageous. Firstly, such carrier blanks are more economical. Carrier blanks made in accordance with the invention have been found to use between about 2% and 15% (or more) less paperboard than prior designs. This allows carrier blanks to be made at a lower cost and is a better, more efficient use of limited natural resources. Such carrier blanks are also compatible with older style in-line gluing machinery without modifying the machinery.

Accordingly, it is a primary object of the present invention to provide a carrier blank for making a basket-style carrier, which carrier blank is more economical to manufacture.

It is another object of the present invention to provide a carrier blank for making a basket-style carrier, which carrier blank makes more efficient use of paperboard.

It is another object of the present invention to provide a carrier blank which can be used to make a basket-style carrier, which carrier blank can be used with existing in-line gluing machinery.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
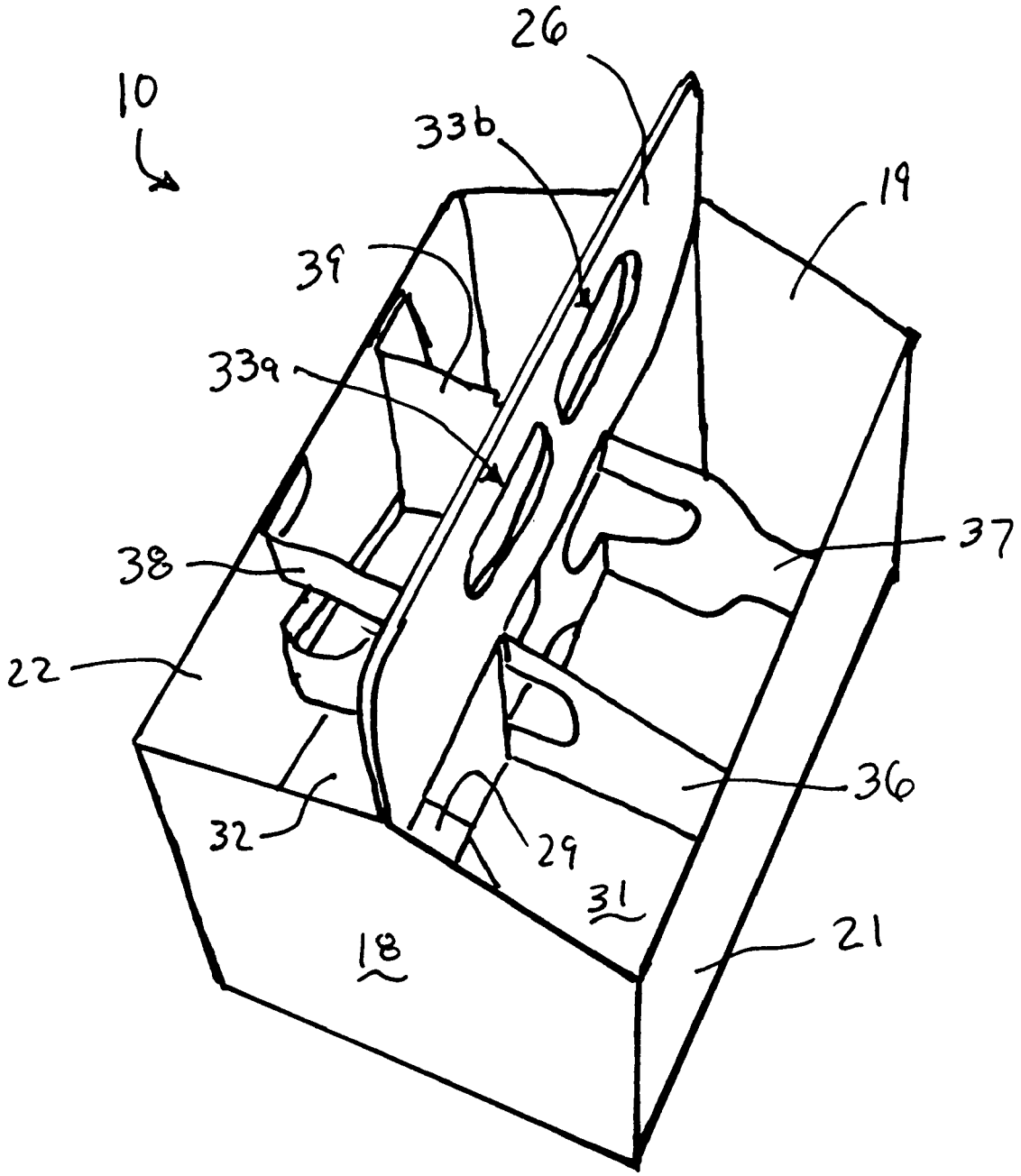
FIG. 1 is a perspective illustration of a basket-style carrier made in accordance with the principles of the present invention and using a carrier blank according to the present invention.
Figure 2:
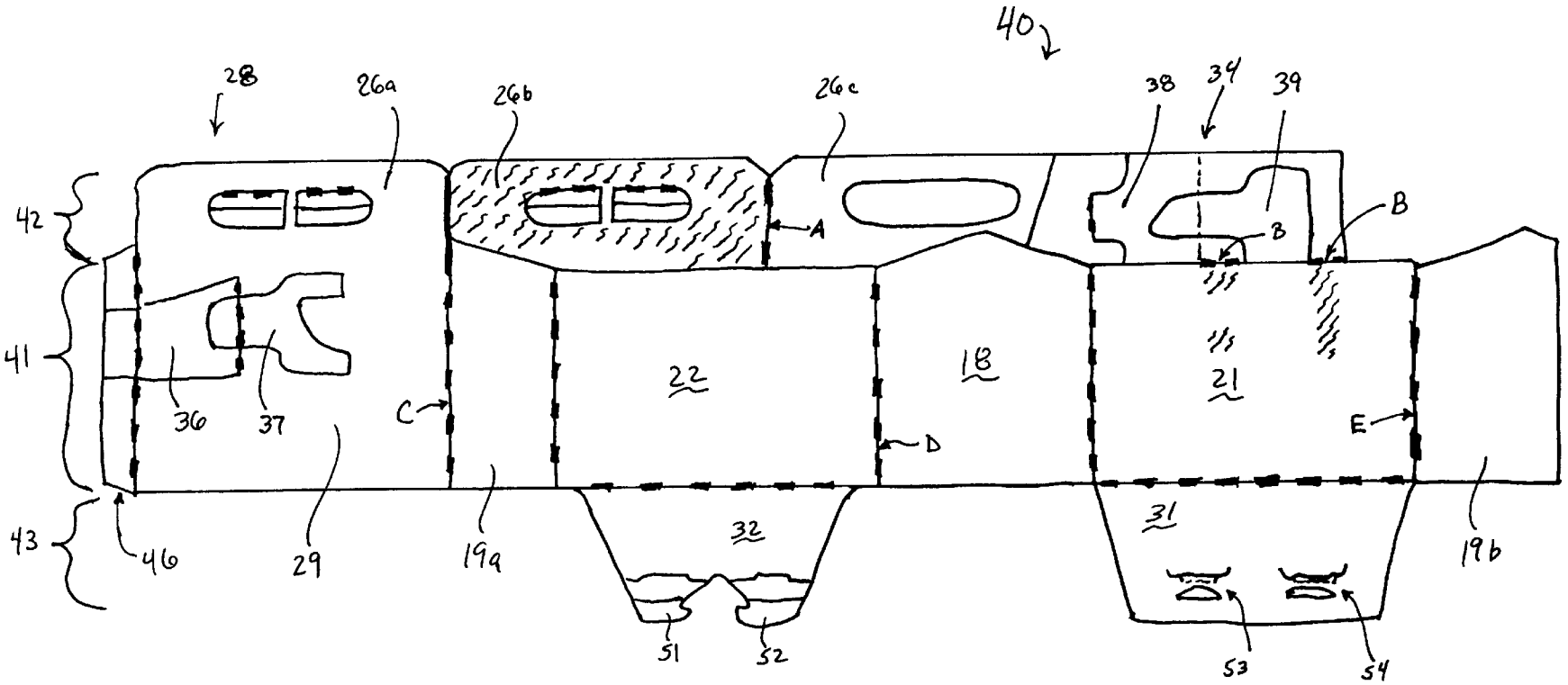
FIG. 2 is a plan view of a carrier blank for making the basket-style carrier of FIG. 1.

Referring now in detail to the drawing figures, wherein like reference numerals depict like parts throughout the several views, FIG. 1 shows a basketstyle carrier 10 made from a compact carrier blank 40 as shown in FIG. 2.

The basket-style carrier 10 according to the invention is configured for carrying six containers, such as beverage bottles or cans. The carrier 10 includes six one-container cells for each holding one container. Those skilled in the art will recognize that the carrier can be configured to hold more or fewer containers.

As depicted in FIG. 1, the basket-style carrier 10 includes first and second end panels 18 and 19 positioned opposite each other. First and second side panels 21 and 22 are opposite each other and are connected to and extend between the end panels 18 and 19. Preferably, the height of the side panels and the end panels is less than the height of the beverage bottles or beverage containers contained therein so that when the carriers are filled and stacked, the weight of the stack above a particular carrier is borne by the bottles or cans, rather than by the end panels and side panels of the carrier. This prevents the end panels and side panels from being crushed when the carriers are filled and stacked.

The basket-style carrier 10 also includes a central upstanding handle 26 to allow the carrier 10 to be grasped and carried. The central upstanding handle 26 is of three-ply construction and is connected to the first end panel 18 and the second end panel 19. The central upstanding handle 26 includes finger openings or grip openings 33*a*, 33*b* to allow the fingers of the user of the carrier 10 to be inserted therethrough for grasping and carrying the basket-style carrier 10. Those skilled in the art will recognize that while two handle openings are depicted, one or more than two handle openings could be provided, as desired.

Still referring to FIG. 1, it can be seen that the central upstanding handle 26 extends the entire length of the basket-style carrier 10 to separate a first triplet of bottles or cans on one side of the handle 26 from a second triplet on the other side. Furthermore, partition straps 36 and 37 extend between the central handle 26 and the side panel 21. Likewise, partition straps 38 and 39 extend between the central handle 26 and the side panel 22. The partition straps 36–39 divide the carrier 10 into six cells and help to keep the bottles or cans separated from one another to minimize undesirable contact from bottles in other cells. Moreover, some of the weight (load) of the bottles or cans is transferred from the side panels 21 and 22 to the central handle 26 through the partition straps. Bottle-to-bottle contact is substantially eliminated.

Advantageously, the handle portion 26 includes a lower portion or skirt 29 which extends below the remainder of the central upstanding handle 26. The downwardly descending skirt 29 also helps to minimize or prevent bottle-to-bottle contact.

The carrier 10 also includes two bottom panels, in particular a bottom panel 31 and a bottom panel 32. The bottom panel 31 is connected to side panel 21, while bottom panel 32 is connected to side panel 22. The bottom panel 31 includes tab openings for receiving locking tabs, as will be described below. If the carrier is to be filled from the bottom, the bottom panels 31 and 32 are glued to each other after filling (or simply are mechanically locked to each other using the tab openings and the locking tabs). Conversely, if the carrier 10 is to be filled from the top, then the bottom panels are secured to one another prior to filling the carrier.

Having now described the general construction of the basket-style carrier 10, attention is directed to FIGS. 2-6 which depict the manufacturing of the carrier 10 from the novel compact carrier blank 40. FIG. 2 shows a carrier blank 40 from which the carrier 10 is fabricated. The carrier blank 40 is precision cut and scored to allow the blank to be folded, glued and ultimately assembled into the finished carrier as depicted in FIG. 1. The blank 40 is formed from paperboard of the type and caliber conventionally used in the carrier industry. The carrier blank 40 depicted in FIG. 2 is shown with some glue or adhesive placed thereon preparatory to an initial folding step.

As best seen in FIG. 2, the carrier blank 40 can be seen to include three elongate sections. Namely, these are the central elongate section 41, the first elongate section or strip 42, and the second elongate section or strip 43. The first outer or exterior section or strip 42 can be seen to include first ply 26*a* of the handle assembly, second ply 26*b*, third ply 26*c*, and a divider flap indicated generally at 34. The divider flap 34 includes partition 38 and partition 39.

The central section 41 includes lower skirt 29 formed in a full height divider panel 28, half panel 19*a* (which forms part of end panel 19 of FIG. 1), side panel 22, end panel 18, side panel 21, and half panel 19*b* (which along with half panel 19*a* forms the end panel 19). It should be noted that half panel 19*b* comprises more than one half of the end panel 19 so that when the half panels 19*a* and 19*b* are brought together, there is some overlap so that they can be secured to one another. The central section 41 also includes partitions 36 and 37. The central section also includes a glue flap indicated generally at 46, which, when the carrier blank is assembled into a finished carrier, is glued to end panel 18 to secure the full height divider 28 in place. The central section 41, as well as the exterior sections 42 and 43, are elongate generally in the direction extending from lower skirt 29 to half panel 19*b*, as can be readily determined from the drawing figures.

Figure 7:
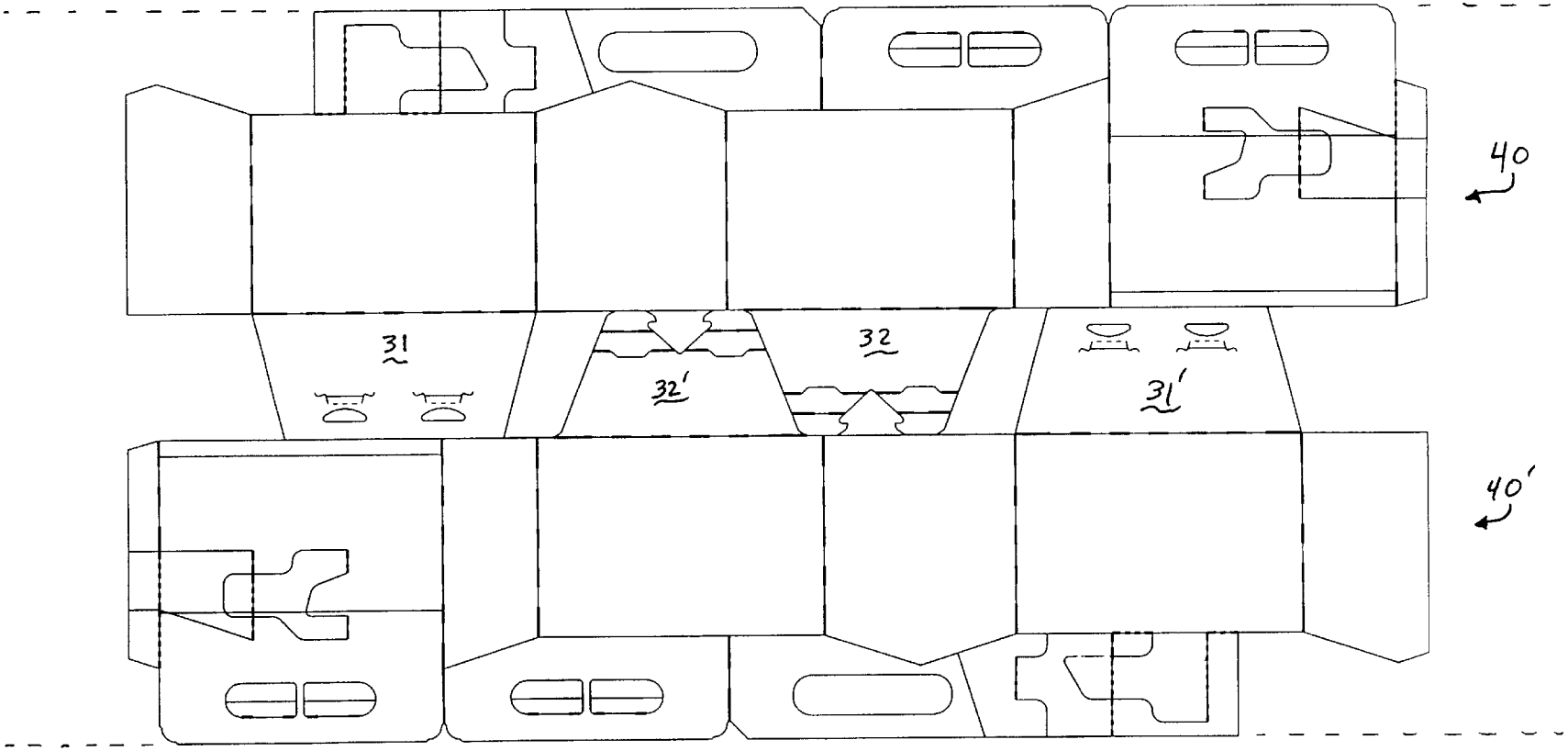
FIG. 7 is a plan view of a "two-up" layout showing the meshing of two carrier blanks of FIG. 2.

The second exterior section 43 includes bottom panels 32 and 31 which include locking tabs and tab openings. For example, bottom panel 32 includes locking tabs 51 and 52 for engaging and cooperating with tab openings 53 and 54. The bottom panels 32 and 31 are tapered to facilitate the nesting thereof with adjacent bottom panels of another carrier blank in a "two-up" layout. This is best seen in FIG. 7 in which one can see that the bottom panels 31 and 32 are nestably received with adjacent bottom panels 32 and 31 of an adjacent carrier blank 40 to minimize waste. Referring again to FIG. 2, it is pointed out that bottom panel 31 extends across the full width (at least at one edge thereof) of side panel 21, while bottom panel 32 nearly extends the full width of side panel 22. If the bottom panels are to be made rectangular, instead of being tapered as shown, the length of the bottom panels could be made to be shorter than the length of the side panels 21 to provide enough room between the bottom panels to facilitate nesting with an adjacent carrier blank in a "two-up" layout. However, the tapered, substantially full-width bottom panels as depicted in FIG. 2 are preferred because they provide maximum strength for the bottom while still allowing nesting with an adjacent carrier blank.

Figure 3:
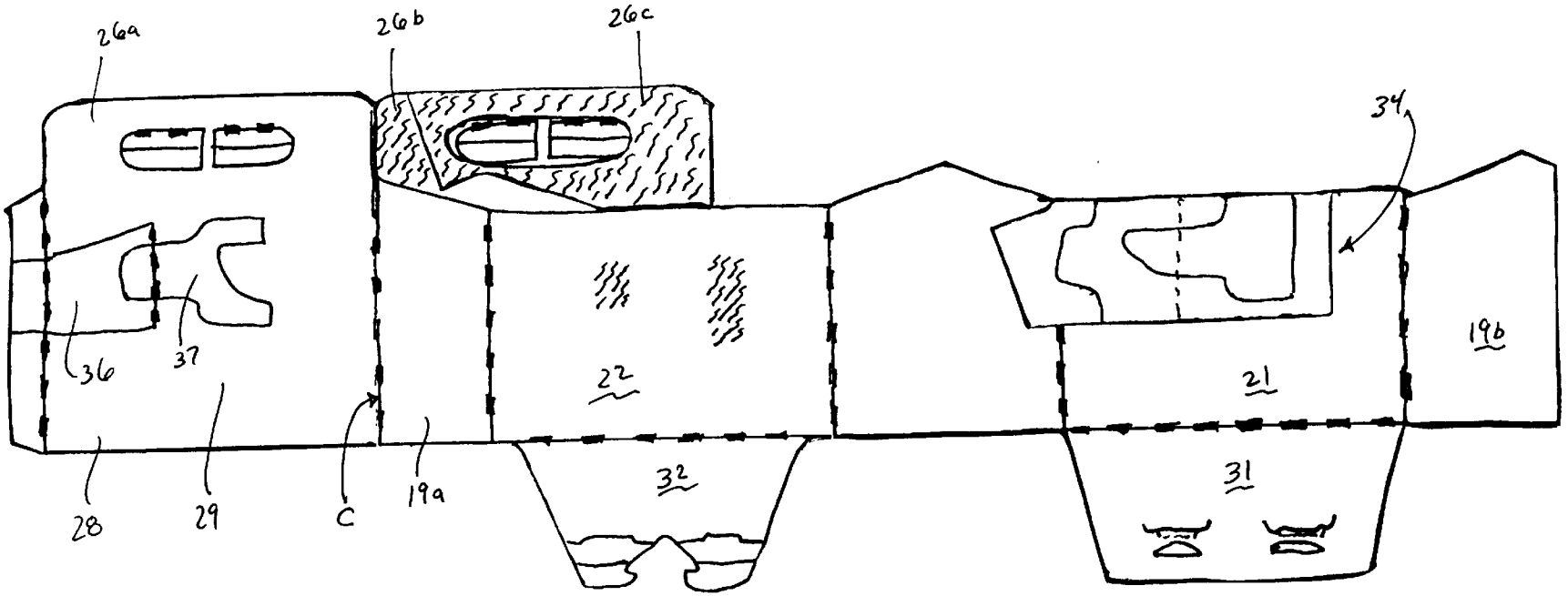
FIG. 3 is an plan view of the carrier blank of FIG. 2 after two initial folding steps.

FIG. 2 shows the carrier blank 40 prior to any folding steps. As shown in FIG. 2, glue is applied to second ply 26*b* of the handle assembly. Also, glue is applied in spots on side panel 21 for securing the divider flap 34 in certain select locations. FIG. 3 shows the carrier blank 40 after a pair of initial folding steps.

Figure 4:
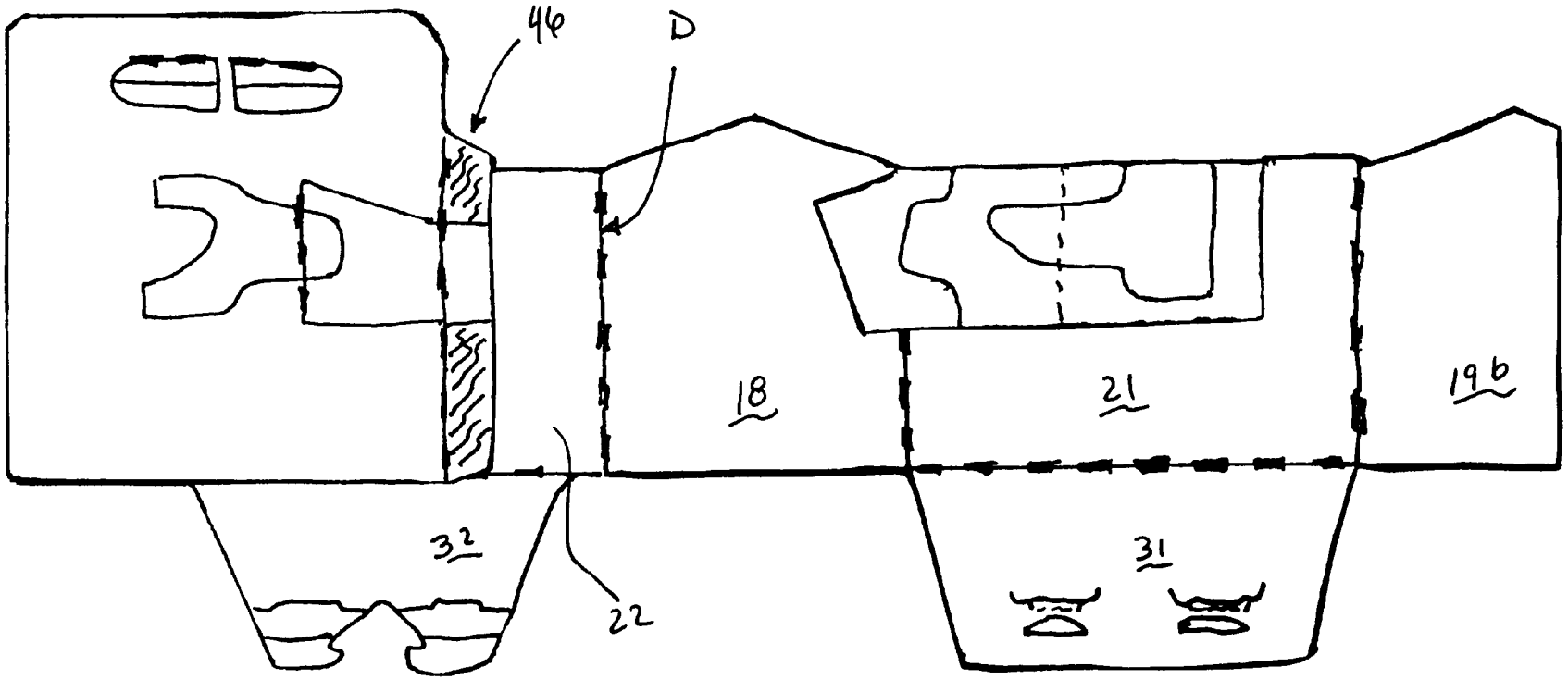
FIG. 4 is a plan view of the carrier blank of FIG. 3 after another folding step.
Figure 5:
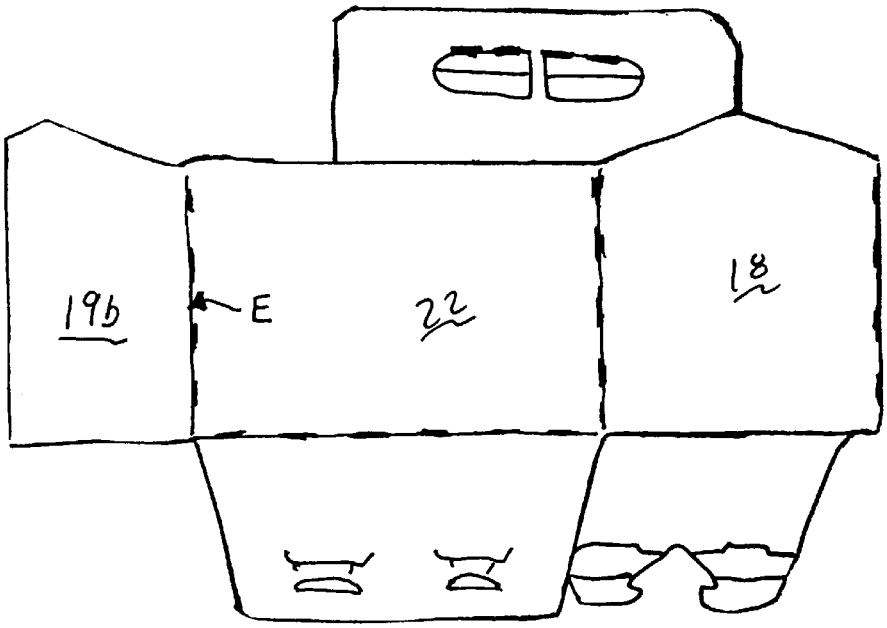
FIG. 5 is a plan view of the carrier blank of FIG. 4 after another folding step.
Figure 6:
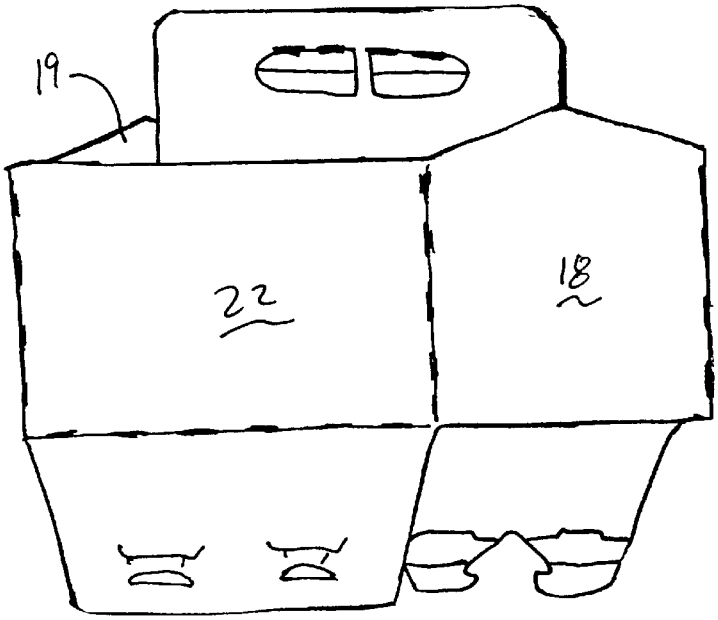
FIG. 6 is a plan view of the carrier blank of FIG. 5 after another folding step.

In FIG. 3, the carrier blank of FIG. 2 has been folded about pre-scored foldlines A and B to fold the third handle ply 26*c* on top of second handle ply 26*b* and to glue it thereto. Also, the divider flap 34 has been folded about pre-scored foldlines B and parts thereof are thereby glued to side panel 21. Glue is then applied to side panel 22 and to the third ply 26*c* of the handle assembly preparatory to folding the full-height divider panel 28 about foldline C (see FIG. 3). Full-height divider panel 28 is folded about foldline C to secure the first handle ply 26*a* to the third handle ply 26*c* and to the second handle ply 26*b*. Also, the partitions 36 and 37 are secured in places to the side panel 22. In this way, the configuration of FIG. 4 is achieved. Glue is then applied to some parts of glue flap 46 in the right side (that portion to the right of foldline D) and the carrier blank is folded about foldline D to fold it on top of the left side (that portion to the left of foldine D). In other words, end panel 18, side panel 21, and half panel 19*b* are folded about foldline D. Glue is then applied to the edge of half panel 19*a* (that edge along foldline C) and half panel 19*b* is folded about foldline E to achieve the folded up, glued configuration of FIG. 6. In this configuration, the carrier blank is ready to be erected, the bottom locked and/or glued, and filled with bottles.

Figure 8:
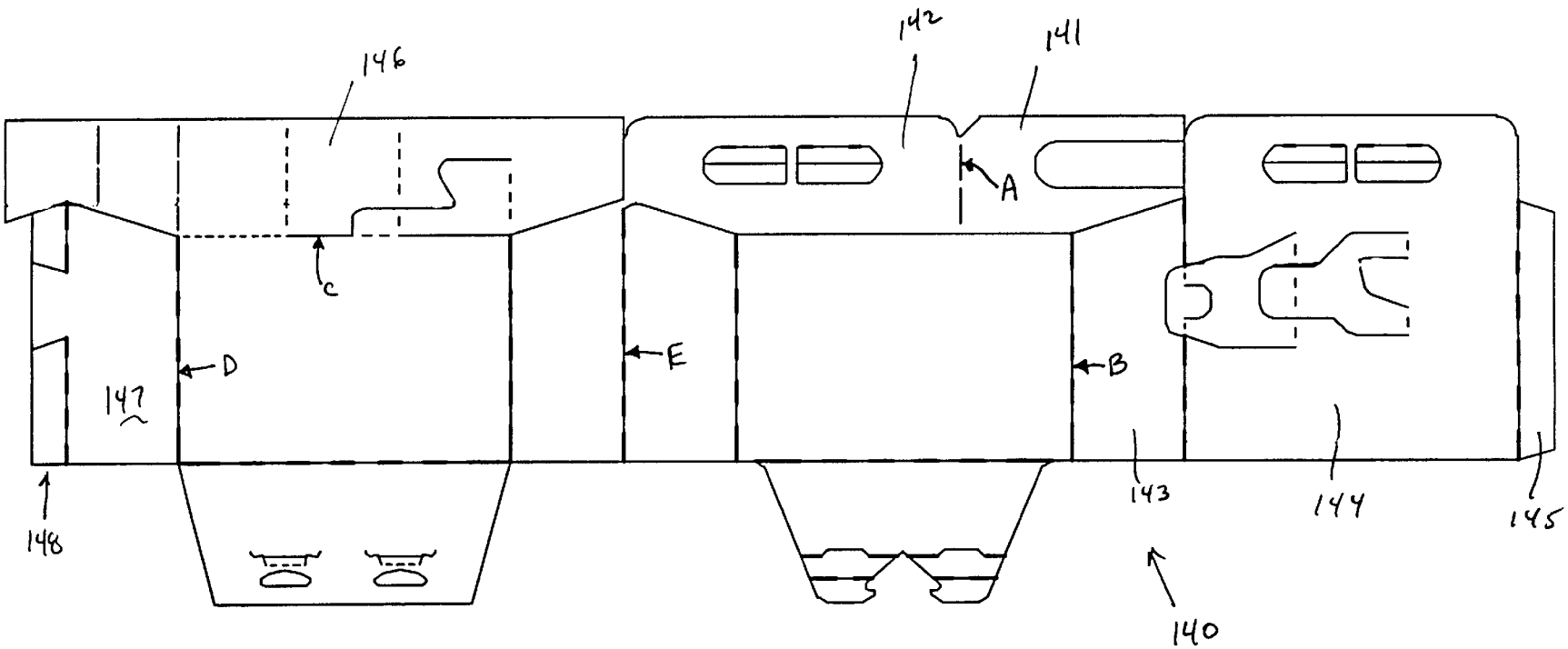
FIG. 8 is a plan view of a carrier blank according to a modified form of the present invention.

The carrier blank just described and the carrier assembled therefrom is of the so called "four crease" type. That is to say that the end panels 18 and 19 (see FIG. 1 and FIG. 6) do not have creases in them. Those skilled in the art will recognize that the present invention can also be applied to so called "six crease" type basket-style carriers. Such a "six crease" type basket-style carrier blank is shown in FIG. 8. In FIG. 8, the carrier blank 140 is made in accordance with the general principles of the invention just described in connection with the four crease basket-style carrier. Note that to assemble a pre-assembled carrier blank from the carrier blank 140 of FIG. 8, the carrier blank is folded according to the folding step sequence A–E. In this way, a handle ply is 141 folded about foldline A on top of a second handle ply 142. Then a half panel 143, a side panel 144, and a glue flap 145 are folded about foldline B. Next, a divider flap 146 is folded about foldline C. Then, half panel 147 and glue flap 148 are folded about foldline D, and then the resulting configuration is folded again at foldline E.

While the invention has been disclosed in preferred forms, it will be apparent to those skilled in the art that many modifications, additions, and deletions can be made therein without departing from the spirit and scope of the invention as set forth in the following claims.

I claim:

1. A carrier blank for making a basket-style carrier for containing and carrying a plurality of articles, said carrier blank comprising:

an elongate central section having an axis of elongation and having formed therein side panels and end panels;

a first exterior section formed alongside said elongate central section and having formed therein a plurality of handle panels, said elongate central section including a handle panel formed as a full height divider panel which spans said elongate central section and said first exterior section, said full height divider panel including a partition for, when said carrier blank is assembled into a finished carrier, extending from said full height divider panel to one of said side panels; said plurality of handle panels comprises said full height divider panel defining a first handle panel hingedly attached to a second handle panel and a third handle panel also hingedly attached to said second handle panel, said first and third handle panels being attached at fold lines extending transversely to said axis of elongation; and a second exterior section formed alongside said elongate central station and positioned opposite said first exterior section, said first and second exterior sections flanking said elongate central section, said second exterior section having first and second bottom panels formed therein, said first and second bottom panels being connected to said side panels and separated from said full height divider.

2. A carrier blank as claimed in claim 1 wherein said first and second bottom panels are sized, shaped, and spaced from one another to create open spaces adjacent said first and second bottom panels to allow bottom panels of an adjacent carrier blank to be nestably received therein.

3. A carrier blank as claimed in claim 1 wherein said bottom panels are tapered.

4. A carrier blank as claimed in claim 1 wherein said plurality of handle panels are hingedly attached to one another about axes which are transverse to said axis of elongation.

5. A carrier blank as claimed in claim 1 wherein said plurality of handle panels are arranged one after another in the direction of said axis of elongation.

6. A carrier blank as claimed in claim 1 wherein said first exterior section also includes a divider flap formed therein for dividing an interior of the basket-style carrier when assembled.

7. A carrier blank as claimed in claim 6 wherein said divider flap folds inwardly from said first exterior section onto said central section.

* * * * *